US005870066A

United States Patent [19]

Asakura et al.

[11] Patent Number: 5,870,066

[45] **Date of Patent: *Feb. 9, 1999**

[54] CHIP ANTENNA HAVING MULTIPLE RESONANCE FREQUENCIES

[75] Inventors: Kenji Asakura, Shiga-ken; Harufumi Mandai, Takatsuki; Teruhisa Tsuru, Kameoka; Seiji Kanba, Otsu; Tsuyoshi Suesada, Omihachiman, all of Japan

[73] Assignee: Murana Mfg. Co. Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 735,104

[22] Filed: Oct. 22, 1996

[30] Foreign Application Priority Data

Dec. 6, 1995 [JP] Japan ..... 7-317885

[51] Int. Cl.[6] ..... H01Q 1/36

[52] U.S. Cl. ..... 343/895; 343/702; 343/873

[58] Field of Search ..... 343/702, 895, 343/700 MS, 846, 873, 893; H01Q 1/36

[56] References Cited

U.S. PATENT DOCUMENTS

| | | | |
|---|---|---|---|
| 3,656,168 | 4/1972 | Stropki | 343/895 |
| 4,070,676 | 1/1978 | Sanford | 343/700 MS |
| 4,218,682 | 8/1980 | Yu | 343/700 MS |
| 4,800,392 | 1/1989 | Garay et al. | 343/700 MS |
| 4,827,271 | 5/1989 | Berneking et al. | 343/700 MS |
| 5,124,733 | 6/1992 | Haneishi | 343/700 MS |
| 5,255,005 | 10/1993 | Terret et al. | 343/895 |
| 5,412,392 | 5/1995 | Tsunekawa | 343/395 |
| 5,450,090 | 9/1995 | Gels et al. | 343/700 MS |
| 5,541,610 | 7/1996 | Imanishi et al. | 343/895 |
| 5,627,551 | 5/1997 | Tsuru et al. | 343/846 |

FOREIGN PATENT DOCUMENTS

| | | |
|---|---|---|
| 0427654 | 5/1991 | European Pat. Off. . |
| 0759646 | 2/1997 | European Pat. Off. . |
| 9312559 | 6/1993 | WIPO . |
| 9417565 | 8/1994 | WIPO . |

OTHER PUBLICATIONS

Xiao–Hai Shen et al., "Study of Gain Enhancement Method for Microstrip Antennas Using Moment Method", IEEE Transactions on Antennas and Propagation, vol. 43, No. 3, Mar. 1995, pp. 227–231.

*Primary Examiner*—Hoanganh T. Le
*Attorney, Agent, or Firm*—Ostrolenk, Faber, Gerb & Soffen, LLP

[57] ABSTRACT

A chip antenna comprising a substrate comprising at least one material selected from dielectric materials and magnetic materials, at least two conductors formed on at least one surface of the substrate or inside the substrate, and at least one feeding terminal provided on the surface of the substrate for applying a voltage to the conductors.

23 Claims, 6 Drawing Sheets

CHIP ANTENNA HAVING MULTIPLE RESONANCE FREQUENCIES

BACKGROUND OF THE INVENTION

1. Field of the Invention

The present invention relates to chip antennas and particularly a chip antenna used for mobile communication and local area networks (LAN).

2. Description of the Related Art

Conventional antennas include monopole antennas and chip antennas, for example.

FIG. 9 shows a typical prior art monopole antenna 1. The monopole antenna 1 has a conductor 2 perpendicular to an earth plate (not shown in the figure) in air (dielectric constant $\epsilon$=1 and relative permeability $\mu$=1), the one end 3 of the conductor 2 forming a feeding section and the other end 4 being a free end.

FIG. 10 is a side view of a typical prior art chip antenna 5. The chip antenna 5 comprises an insulator 6, a coil conductor 7, a magnetic member 8, and external connecting terminals 9*a* and 9*b*.

Each of the prior art monopole antenna and chip antenna set forth above has only one feeding section and conductor, and thus has only one resonance frequency. Thus, a plurality of monopole antennas or chip antennas are required for responding to two or more different resonance frequencies, and they are not applicable to uses, requiring compact antennas, such as mobile communication, for the reason of their sizes.

SUMMARY OF THE INVENTION

It is an object of the present invention to provide a compact chip antenna which can respond to a plurality of resonance frequencies, and thus can be used for mobile communication and the like.

In accordance with the present invention, a chip antenna comprises a substrate comprising at least one material selected from dielectric materials and magnetic materials, at least two conductors formed on at least one of a surface of the substrate and inside the substrate, and at least one feeding terminal provided on the surface of the substrate for applying a voltage to the conductors.

Preferably, the conductors connect with each other in series or in parallel.

Because the chip antenna in accordance with the present invention has a plurality of conductors, the single chip antenna can respond to a plurality of resonance frequencies.

Other features and advantages of the present invention will become apparent from the following description of the invention which refers to the accompanying drawings.

DETAILED DESCRIPTION OF EMBODIMENTS OF THE INVENTION

Embodiments in accordance with the present invention will now be explained with reference to drawings.

Figure 1:
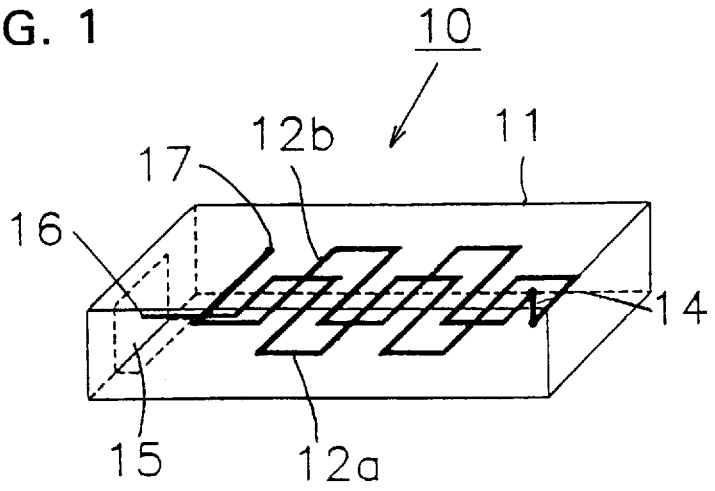
FIG. 1 is an isometric view illustrating a first embodiment of a chip antenna in accordance with the present invention.
Figure 2:
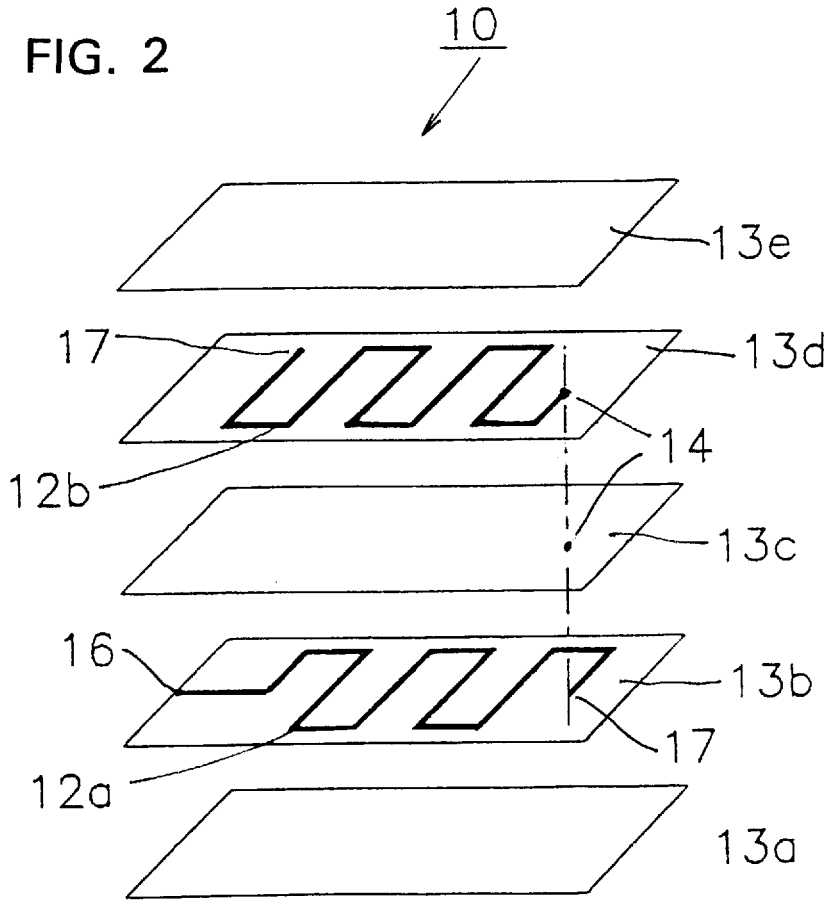
FIG. 2 is a decomposed isometric view of the chip antenna in FIG. 1.

FIG. 1 is an isometric view illustrating a first embodiment of a chip antenna in accordance with the present invention, and FIG. 2 is a decomposed isometric view of the chip antenna.

The chip antenna 10 comprises meander conductors 12*a* and 12*b* each having a plurality of corners in a rectangular parallelopiped substrate 11. The substrate 11 is formed by laminating rectangular dielectric sheet layers 13*a* through 13*e* each comprising a dielectric material (dielectric constant=ca. 6.1) mainly containing barium oxide, aluminum oxide and silica. Meander conductors 12*a* and 12*b* comprising copper or a copper alloy are provided on the surfaces of the sheet layers 13*b* and 13*d* by printing, evaporation, adhesion, or plating. A via hole 14 is provided at the one end of the conductor 12*b* on the sheet layer 13*d* and through the layer 13*c*. Two meander conductors 12*a* and 12*b* are formed inside the substrate 11 by laminating the sheet layers 13*a* through 13*e*, where the one end of the conductor 12*a* and the one end of the conductor 12*b* connect with each other through the via hole 14 inside the substrate 11.

The other end of the conductor 12*a* is drawn out to the surface of the substrate 11 to form a feeding section 16 which connects with a feeding terminal 15 formed on the surface of the substrate 11 for applying a voltage to the conductors 12*a* and 12*b*. The other end of the conductor 12*b* forms a free end 17 inside the substrate 11. In this case, the conductors 12*a* and 12*b* connect with each other through the via hole 14 in series to the feeding terminal 15.

Figure 3:
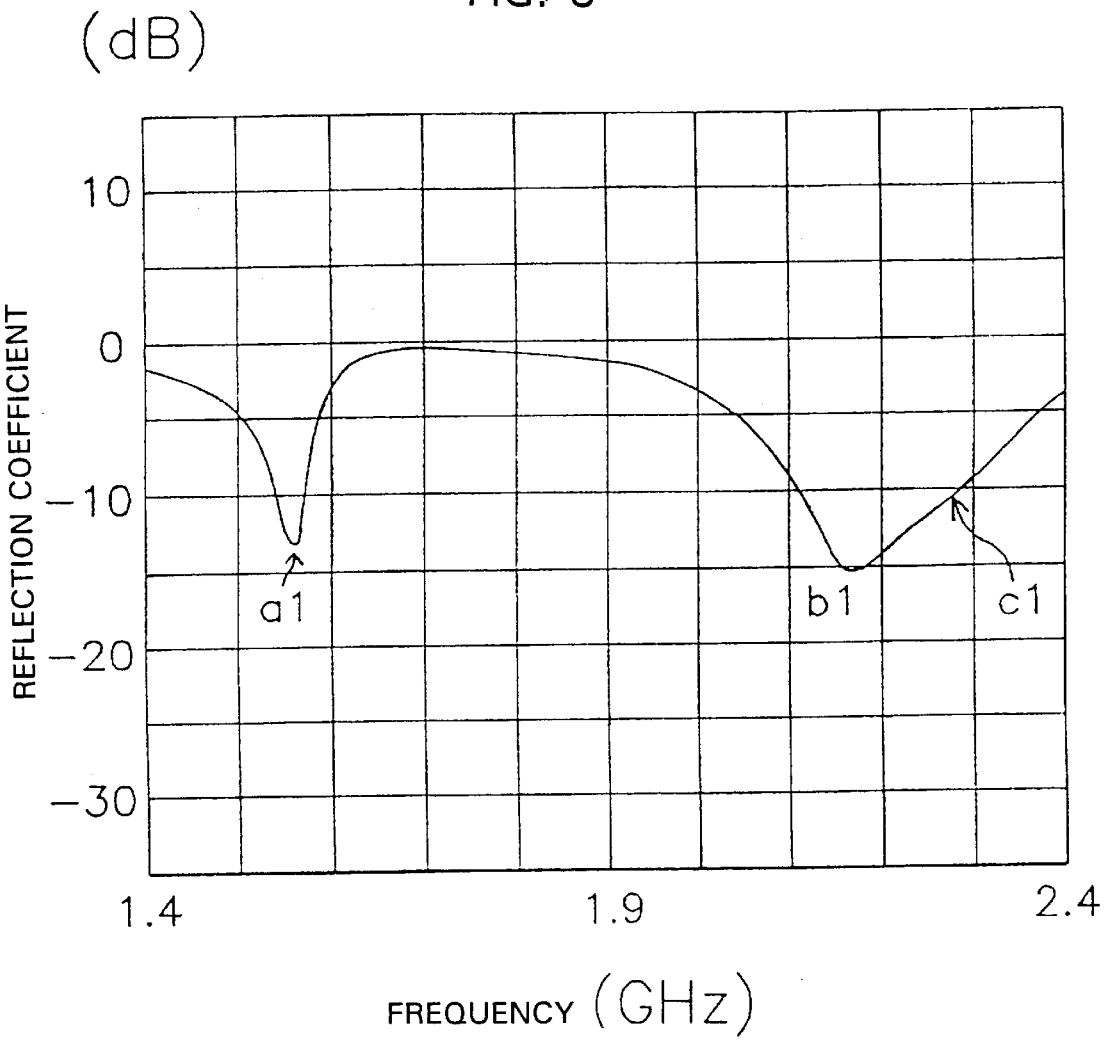
FIG. 3 is a graph illustrating reflection loss characteristics of the chip antenna in FIG. 1.

FIG. 3 is a graph illustrating the reflection loss characteristics of the antenna 10. The antenna 10, in which the conductors 12*a* and 12*b* connect with each other in series, exhibits a resonance frequency corresponding to the conductor 12*a* at approximately 2.17 [GHz] (b1 in FIG. 3), a resonance frequency corresponding to the conductor 12*b* at approximately 2.27 [GHz] (c1 in FIG. 3), and a resonance frequency due to the coupling of the conductors 12*a* and 12*b* at approximately 1.56 [GHz] (a1 in FIG. 3). Accordingly, the antenna in the embodiment set forth above can respond to three different resonance frequencies, i.e, 1.56 [GHz], 2.17 [GHz] and 2.27 [GHz].

Figure 4:
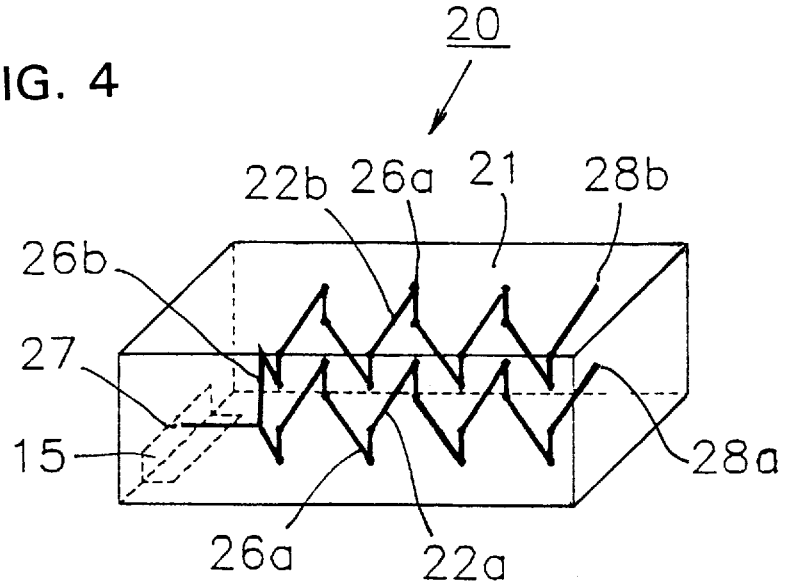
FIG. 4 is an isometric view illustrating a second embodiment of a chip antenna in accordance with the present invention.
Figure 5:
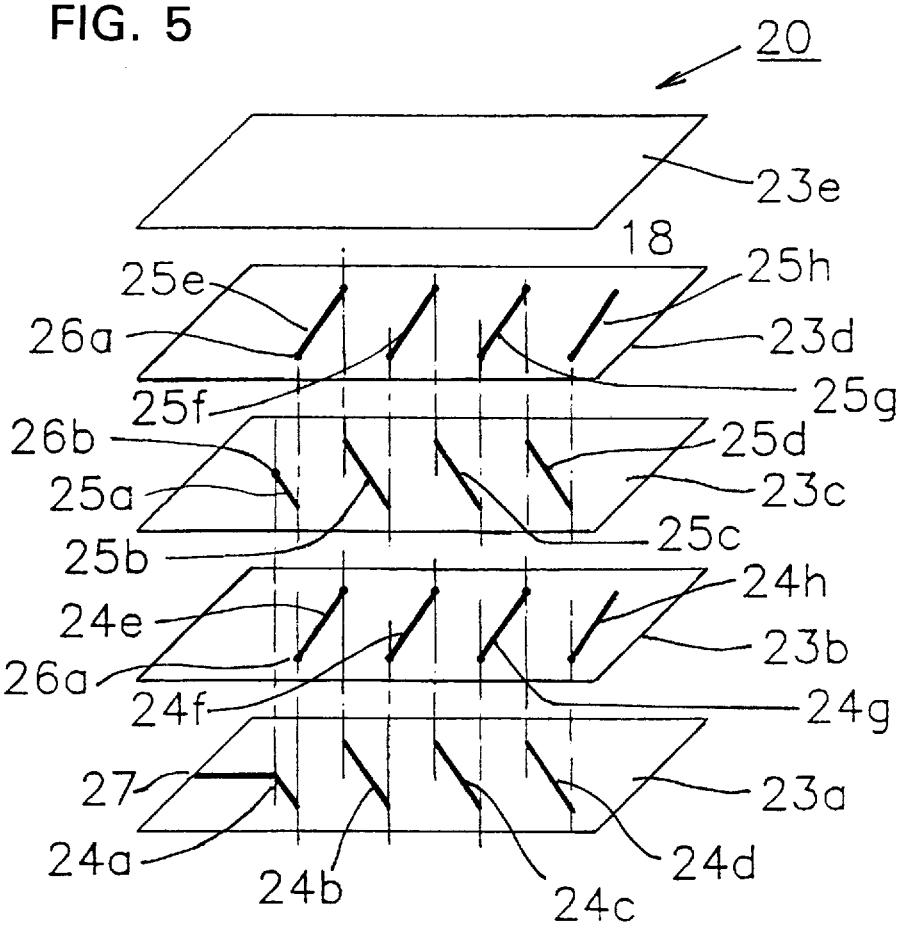
FIG. 5 is a decomposed isometric view of the chip antenna in FIG. 4.

FIG. 4 and FIG. 5 are an isometric view and a decomposed isometric view, respectively, illustrating a second embodiment of a chip antenna in accordance with the present invention.

The chip antenna 20 is provided with two conductors 22*a* and 22*b* spirally coiled inside a rectangular parallelopiped substrate 21 in the longitudinal direction of the substrate 21. The substrate 21 comprises rectangular sheet layers 23*a* through 23*e* comprising a dielectric material, e.g., having a dielectric constant=ca. 6.1 and mainly containing barium oxide, aluminum oxide and silica. The sheet layers 23*a* through 23*d* are provided with L-shape or linear conductive patterns 24*a* through 24*h* and 25*a* through 25*h* each comprising, e.g., copper or a copper alloy on the surfaces of their respective sheet layers, by printing, evaporation, adhesion and plating. Further, via holes 26*a* are provided at both ends of the conductors 24*e* through 24*g* and 25*e* through 25*g* and at the one end (26*b*) of the conductors 24*h*, 25*a* and 25*h* on the sheet layer 23*b* through 23*d* along the vertical direction. When the sheet layers 23*a* through 23*e* are stacked and the conductive patterns 24*a* through 24*h* and 25*a* through 25*h* connect with each other through via holes 26, spirally coiled conductors 22*a* and 22*b* each having a rectangular cross-section are formed. The one end of the conductor 22*a* and the one end of the conductor 22*b* connect with each other through a via hole 26*b*.

Further, the one of the ends of conductors 22*a* and 22*b* (one of the ends of conductive patterns 24*a* and 25*a*) are drawn out at the surface of the substrate 21 to form a feeding section 27 which connects with the feeding terminal 15 on the surface of the substrate 21. The other ends of the conductors 22*a* and 22*b* (the other ends of conductive patterns 24*h* and 25*h*) form free ends 28*a* and 28*b*, respectively, inside the substrate 21. In this case, the conductors 22*a* and 22*b* connect with each other in parallel to the feeding terminal 15 through the via hole 26*b*.

Figure 6:
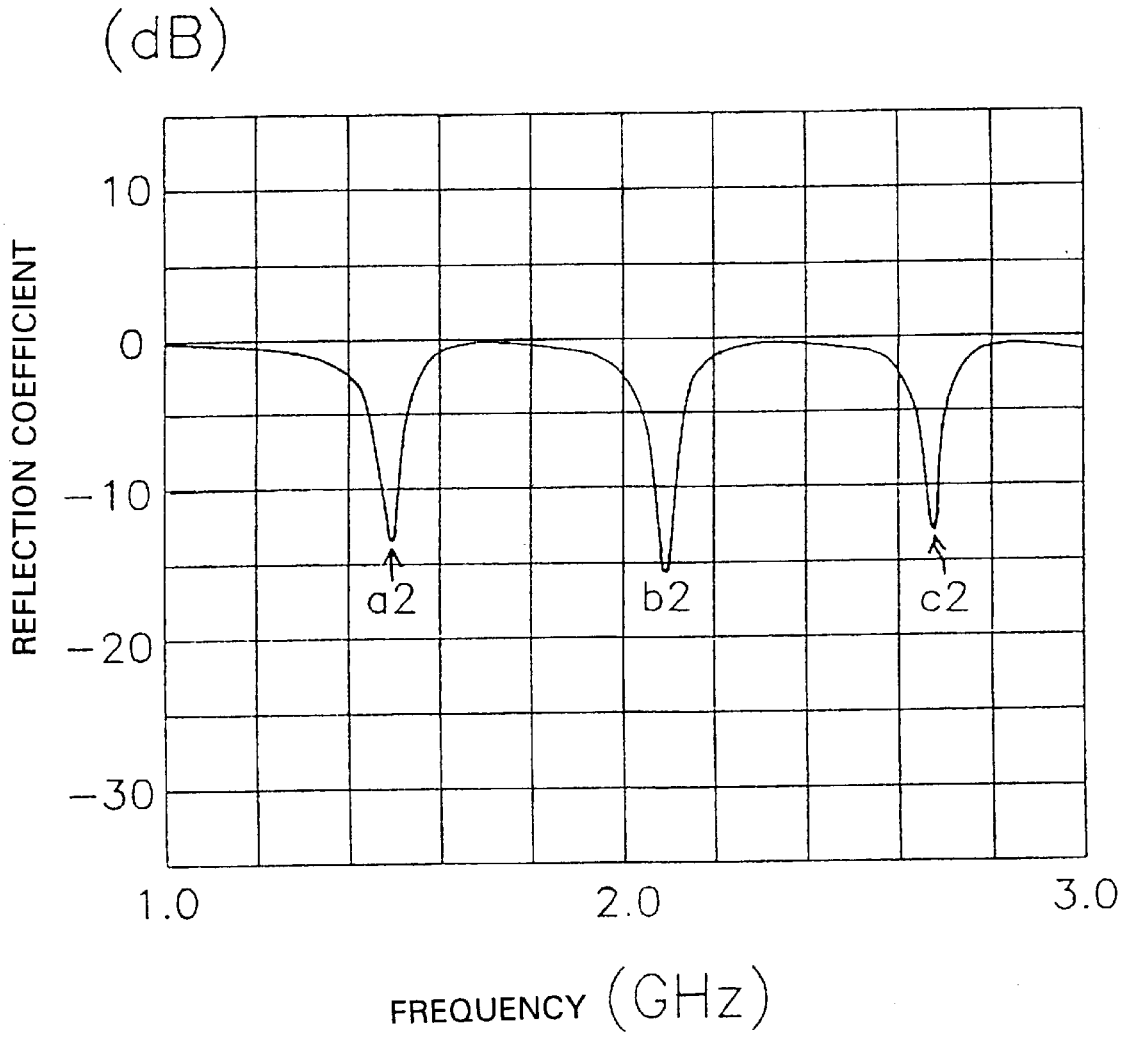
FIG. 6 is a graph illustrating reflection loss characteristics of the chip antenna in FIG. 4.

FIG. 6 is a graph illustrating reflectance loss characteristics of the antenna 20. FIG. 6 demonstrates that a resonance frequency for the conductor 22*a* appears near 1.50 [GHz] (a2 in the figure), a resonance frequency for the conductor 22*b* appears near 2.09 [GHz] (b2 in the figure), and a resonance frequency due to coupling of the conductors 22*a* and 22*b* appears near 2.66 [GHz] (c2 in the figure).

As set forth above, this antenna can respond to three different resonance frequencies, i.e., 1.50 [GHz], 2.09 [GHz], and 2.66 [GHz].

Figure 7:
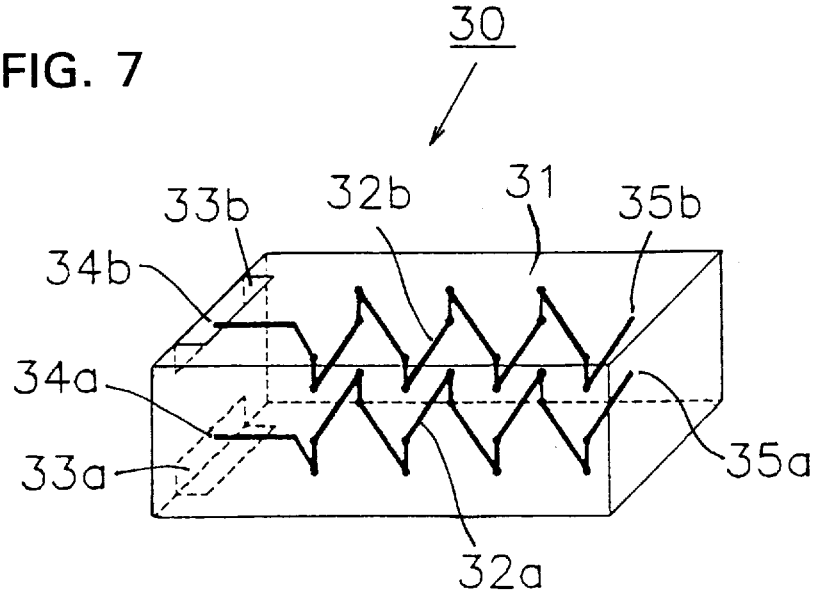
FIG. 7 is an isometric view illustrating a third embodiment of a chip antenna in accordance with the present invention.
Figure 9:
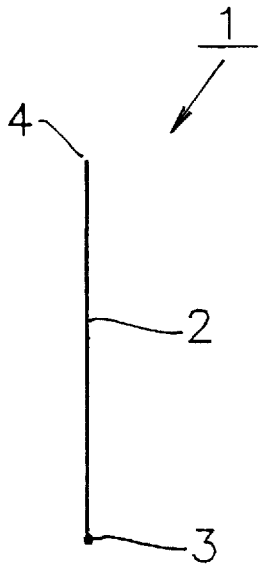
FIG. 9 PRIOR ART
FIG. 9 is a schematic view of a conventional monopole antenna.
Figure 10:
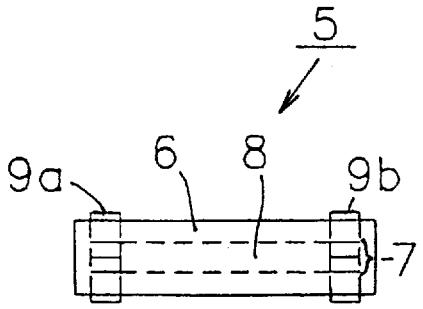
FIG. 10 PRIOR ART
FIG. 10 is a side view of a conventional chip antenna.

FIG. 7 is an isometric view of a third embodiment of the chip antenna in accordance with the present invention.

The chip antenna 30 comprises a rectangular parallelopiped substrate 31 comprising a dielectric material, for example, having a dielectric constant: ca. 6.1 and mainly containing barium oxide, aluminum oxide and silica; conductors 32*a* and 32*b* which comprise, e.g., copper or a copper alloy, and is spirally coiled inside the substrate 31 along the longitudinal direction; and feeding terminals 33*a* and 33*b* provided at the side, top face and bottom face for applying a voltage to the conductors 32*a* and 32*b*. The one ends of the conductors 32*a* and 32*b* form feeding sections 34*a* and 34*b* which connect with feeding terminals 33*a* and 33*b*, respectively. The other ends of the conductors 32*a* and 32*b* form free ends 35*a* and 35 inside the substrate 31. In this case, the conductors 32*a* and 32*b* are independently formed inside the substrate 31.

Figure 8:
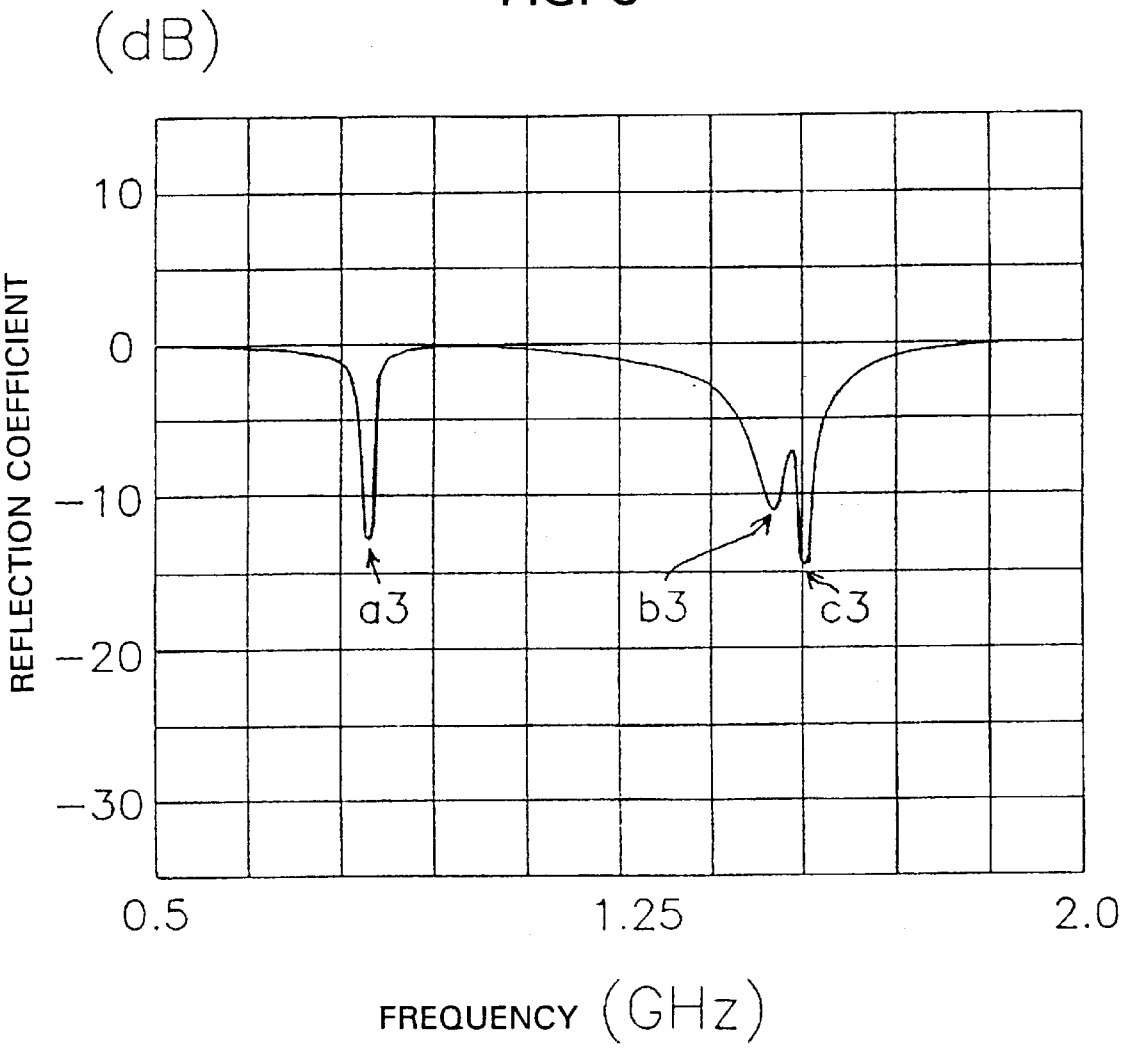
FIG. 8 is a graph illustrating reflection loss characteristics of the chip antenna in FIG. 7.

FIG. 8 is a graph illustrating reflectance loss characteristics of the antenna 30 comprising the conductors 32*a* and 32*b* formed independently. FIG. 8 demonstrates that a resonance frequency for the conductor 32*a* appears near 0.85 [GHz] (a3 in the figure), a resonance frequency for the conductor 32*b* appears near 1.50 [GHz] (b3 in the figure), and a resonance frequency corresponding to the second harmonic of the conductor 32*a* appears near 1.55 [GHz] (c3 in the figure).

As set forth above, the antenna in the third embodiment can respond to two different resonance frequencies at 0.85 [GHz], and 1.50 [GHz]. Further, the bandwidth near 1.50 [GHz] can be expanded by the second harmonic.

In this case, when the conductors 32*a* and 32*b* are provided so that the coiling axis of the conductor 32*a* is perpendicular to that of the conductor 32*b*, coupling between two conductors can be suppressed, and thus the resonance frequency can be readily controlled.

In the first through third embodiments set forth above, although the substrate of each chip antenna comprises a dielectric material mainly containing barium oxide, aluminum oxide and silica, other dielectric materials mainly containing titanium oxide and/or neodymium oxide, magnetic materials mainly containing nickel, cobalt, and/or iron, and combinations of dielectric materials and magnetic materials also can be used as the substrate.

Although each antenna has two conductors in the embodiments set forth above, the antenna can have three or more conductors for providing more resonance frequencies. For example, the antenna having three conductors can respond to four different resonance frequencies.

The conductors can be provided on at least one side of the surface of the substrate and inside the substrate, other than inside of the substrate as set forth in each embodiment.

Although the conductor is meanderingly formed in the first embodiment, the conductor can be spirally coiled. In contrast, the conductors in the second and third embodiments which are spirally coiled, can also be meanderingly formed.

In the second and third embodiments, the conductors can be spirally coiled in the vertical direction of the substrate, as well as in the longitudinal direction.

Further, the feeding terminal can be provided at any appropriate position of the substrate, and is not limited to the positions shown.

Since the chip antenna in accordance with the present invention having a plurality of conductors can respond to a plurality of resonance frequencies, a multi-band antenna system can be achieved. Further, the band width can be expanded by adjoining a plurality of resonance frequencies to each other.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a substrate comprising a plurality of sheet layers stacked on each other, said sheet layers each comprising at least one of a dielectric material and a magnetic material, the sheet layers each having a surface, the surface of each layer establishing a stacking direction normal to the surface of each layer, the substrate comprising the plurality of sheet layers having a substrate surface;

a first conductor disposed inside said substrate;

a second conductor disposed inside said substrate;

at least one feeding terminal provided on the surface of said substrate for applying a voltage to at least one of said conductors;

wherein a plurality of first conductive patterns and a plurality of second conductive patterns are provided on respective surfaces of said sheet layers;

said first and second conductors being formed respectively by said plurality of first conductive patterns and said plurality of second conductive patterns, the first and second conductors extending one of meanderingly and spirally perpendicular to the stacking direction of said substrate, and each of said first and second conductors has a different resonance frequency wherein the chip antenna has at least two resonance frequencies.

2. A chip antenna according to claim 1, wherein said first and second conductors connect with each other in series.

3. A chip antenna according to claim 1, wherein said first and second conductors connect with each other in parallel.

4. A chip antenna according to claim 1, wherein said chip antenna further comprises at least one fixing terminal to fix said substrate to a mounting board.

5. A chip antenna according to claim 1, wherein a first feeding terminal is provided on the surface of said substrate for applying a voltage to said first conductor, and a second feeding terminal is provided on the surface of said substrate for applying a voltage to said second conductor.

6. A chip antenna according to claim 1, wherein the first conductor is disposed on a surface of a first layer and the second conductor is disposed on a surface of a second layer, said layers being laminated together.

7. A chip antenna according to claim 6, wherein the first and second conductors are coupled together by a conductive through hole disposed through at least one of the layers.

8. A chip antenna according to claim 1 wherein portions of said first conductor are disposed on at least two layers, portions of said second conductor are disposed on at least two layers, a conductive through hole being provided in at least one of said layers connecting respective portions of the first conductor together when the layers are laminated together and a conductive through hole being provided in at least one of said layers connecting respective portions of the second conductor together when the layers are laminated together.

9. A chip antenna according to claim 1, wherein the first and second conductor each have a feeding terminal.

10. A chip antenna according to claim 1, wherein at least one of said conductors has a free end.

11. A chip antenna according to claim 1, wherein both said conductors have a free end.

12. A chip antenna according to claim 1, wherein the conductors comprise copper or a copper alloy.

13. A chip antenna according to claim 1, wherein the substrate comprises a combination of a dielectric and a magnetic material.

14. A chip antenna according to claim 1, wherein the dielectric material comprises barium oxide, aluminum oxide and silica.

15. A chip antenna according to claim 1, wherein the dielectric material comprises at least one of titanium oxide and neodymium oxide.

16. A chip antenna according to claim 1, wherein the magnetic material comprises at least one of nickel, cobalt and iron.

17. A chip antenna according to claim 1, wherein the chip antenna has three resonance frequencies.

18. A chip antenna according to claim 17, wherein at least two of the resonance frequencies are spaced close together so that an area of extended bandwidth can be achieved near the two resonance frequencies.

19. A chip antenna according to claim 1, wherein the substrate comprises a rectangular parallelopiped.

20. A chip antenna according to claim 1, wherein said first conductor has a rectangular cross section.

21. A chip antenna according to claim 1, wherein said second conductor has a rectangular cross-section.

22. A chip antenna comprising:

a substrate comprising at least one of a dielectric material and a magnetic material, said substrate comprising a plurality of laminated layers each having a surface;

a plurality of conductors each disposed inside the substrate, at least a portion of each conductor being disposed on at least one of said layers, each of said conductors extending one of spirally and meanderingly along and about a longitudinal axis of the substrate, the longitudinal axis being parallel to the surfaces of said plurality of layers;

at least one feeding terminal provided on a surface of the substrate for applying a voltage to at least one of the conductors; and said plurality of conductors providing said antenna with a plurality of resonance frequencies.

23. A chip antenna comprising:

a substrate comprising at least one of a dielectric material and a magnetic material, said substrate comprising a plurality of laminated layers each having a surface;

a first conductor disposed inside said substrate;

a second conductor disposed inside said substrate; and at least one feeding terminal provided on the surface of said substrate for applying a voltage to at least one of said conductors;

said first and second conductors each having a different resonance frequency wherein the chip antenna has at least two resonance frequencies, said first and second conductors extending one of spirally and meanderingly along and about a longitudinal axis of the substrate, the longitudinal axis being parallel to the surfaces of said plurality of laminated layers.

* * * * *